US008590751B2

(12) United States Patent
Ciavarella et al.

(10) Patent No.: US 8,590,751 B2
(45) Date of Patent: Nov. 26, 2013

(54) UTILITY PANEL FOR A DISPENSER

(75) Inventors: Nick Ciavarella, Seven Hills, OH (US); Dean DeCarlo, Hudson, OH (US); David D. Hayes, Wooster, OH (US)

(73) Assignee: GOJO Industries, Inc., Akron, OH (US)

( * ) Notice: Subject to any disclaimer, the term of this patent is extended or adjusted under 35 U.S.C. 154(b) by 204 days.

(21) Appl. No.: 13/041,942

(22) Filed: Mar. 7, 2011

(65) Prior Publication Data

US 2012/0228326 A1 Sep. 13, 2012

(51) Int. Cl.

| | |
|---|---|
| ***B67D 7/06*** | (2010.01) |
| ***B67D 1/07*** | (2006.01) |
| ***B65H 1/00*** | (2006.01) |
| ***G09F 3/10*** | (2006.01) |
| ***G09F 19/00*** | (2006.01) |

(52) U.S. Cl.

USPC ..... 222/181.3; 222/192; 222/105; 221/283; 40/299.01; 40/407

(58) Field of Classification Search

USPC ..... 222/181.1, 181.3, 100, 105, 180, 192; 221/283; 40/219, 124.06, 406–408, 40/299.01, 658; 248/309.1, 312.1, 313, 248/316.7, 447.1, 447.2

See application file for complete search history.

(56) References Cited

U.S. PATENT DOCUMENTS

| | | | | |
|---|---|---|---|---|
| 1,504,826 | A * | 8/1924 | Larsen | 40/716 |
| 3,265,246 | A * | 8/1966 | Messenger | 221/283 |
| 5,197,705 | A * | 3/1993 | Baskas | 248/316.7 |
| 5,695,124 | A * | 12/1997 | Demeny et al. | 239/327 |
| 6,129,291 | A * | 10/2000 | Commeville | 239/24 |
| 6,325,245 | B1 | 12/2001 | Matthews | |
| 6,612,057 | B2 * | 9/2003 | Shoemaker et al. | 40/607.02 |
| 6,966,463 | B1 * | 11/2005 | Yeager et al. | 222/181.3 |
| 7,156,353 | B2 * | 1/2007 | Kringel et al. | 248/311.2 |
| 7,441,736 | B2 * | 10/2008 | Wiltfang | 248/220.42 |
| 2006/0000848 | A1 | 1/2006 | Humphrey | |
| 2006/0162210 | A1 | 7/2006 | Bauer | |
| 2007/0241120 | A1 | 10/2007 | Henry | |
| 2008/0263920 | A1 * | 10/2008 | Trigg et al. | 40/299.01 |
| 2010/0064558 | A1 | 3/2010 | Pelfrey et al. | |
| 2010/0301183 | A1 * | 12/2010 | Carnevali | 248/346.04 |

FOREIGN PATENT DOCUMENTS

| | | |
|---|---|---|
| GB | 2 115 376 A | 9/1983 |
| GB | 2 155 228 A | 9/1985 |
| WO | 0003295 A1 | 1/2000 |

OTHER PUBLICATIONS

WIPO, International Search Report issued by the European Patent Office in PCT Application No. PCT/US2012/025364 (which claims priority from subject U.S. Patent Application); Completion of Search: Apr. 25, 2012; Mailing Date: May 7, 2012.

* cited by examiner

*Primary Examiner* — Paul R Durand
*Assistant Examiner* — Matthew Lembo
(74) *Attorney, Agent, or Firm* — Renner, Kenner, Greive, Bobak, Taylor & Weber

(57) ABSTRACT

A utility panel for a dispenser that is mounted to a support structure by a backplate includes opposed lateral legs that extend from a main section to form a receiving channel therebetween. The main section is configured to display any desired physical indicia, such as advertising messages, for viewing by the user of the dispenser, while the lateral sections include retention tabs that are received within guide channels formed between the backplate and the support structure. As the utility panel is attached to the dispenser, the blackplate is received within the receiving channel of the utility panel until the retention tabs are snap-fit into corresponding lock channels provided by the backplate of the dispenser. As such, the utility panel is easily retrofit to a previously-installed dispenser without the use of tools.

21 Claims, 15 Drawing Sheets

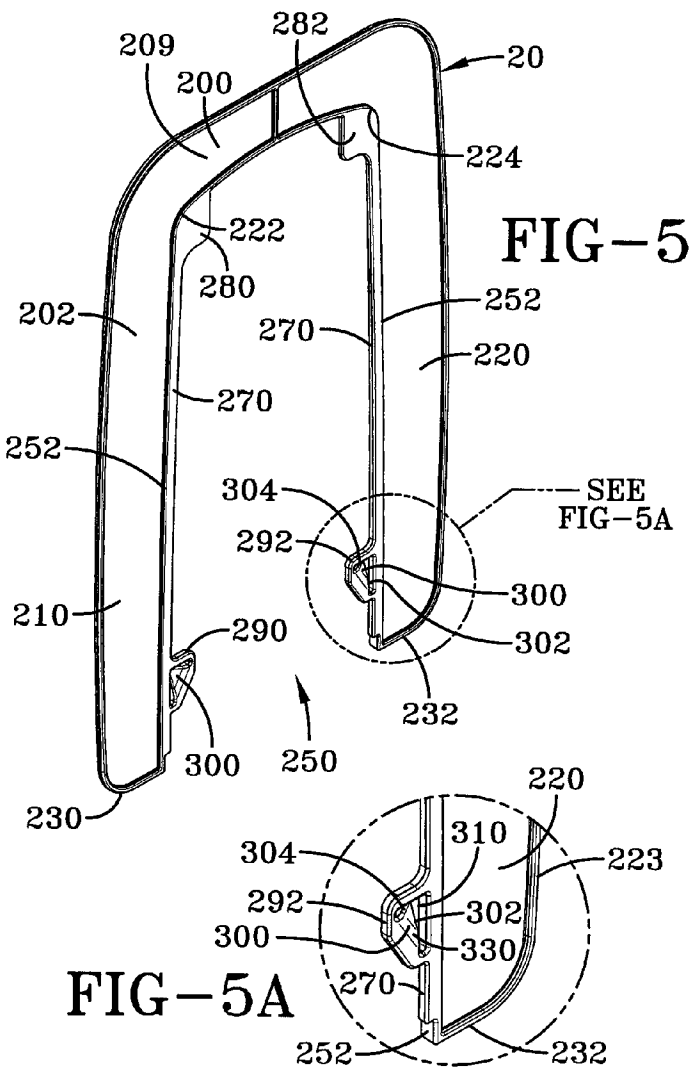
FIG-5
FIG-5A
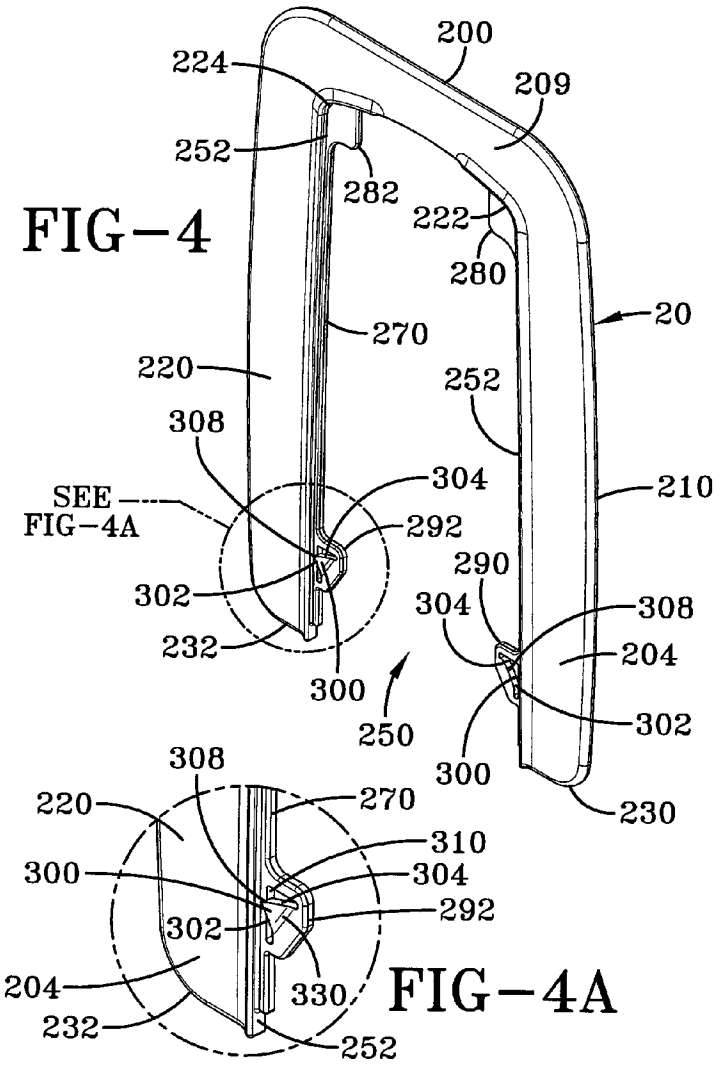
FIG-4
FIG-4A

UTILITY PANEL FOR A DISPENSER

TECHNICAL FIELD

Generally, the present invention relates to dispensers for dispensing material, such as soap. In particular, the present invention relates to a utility panel configured to be retrofit to an installed dispenser. More particularly, the present invention relates to a utility panel configured to be readily retrofit to a compatible backplate, such as that provided by a previously-installed dispenser.

BACKGROUND ART

Dispensers have been installed in many locations where there is a need for the convenient dispensing of material, such as soap, sanitizer, or moisturizer therefrom. Because these dispensers provide a convenient source of material, they offer opportunities in which informational content can be communicated to the users of the dispenser.

Unfortunately, existing dispensers fail to provide a system in which advertisements or other informational content can be provided, and as such, opportunities to communicate such messages with the users of the dispensers are lost. And while existing dispensers can be replaced with new dispensers that can display informational content, such an endeavor is generally cost-prohibitive and results in waste.

Therefore, there is a need for a utility panel that can be easily retrofit to an existing dispenser. Additionally, there is a need for a utility panel that can be retrofit to an existing dispenser having a compatible backplate, which provides a system to display informational content.

SUMMARY OF INVENTION

In light of the foregoing, it is a first aspect of the present invention to provide a utility panel for a backplate, the backplate configured to be mounted to a support structure so as to form an at least one guide channel therebetween, the backplate including a lock tab associated with at least one guide channel, the utility panel comprising a plate having a pair of spaced lateral sections extending at a substantially right angle from a main section to form a receiving channel therebetween configured to receive the backplate therein; and a retention tab extending from at least one said lateral section, said retention tab configured to engage the at least one lock tab as at least one of said lateral sections is received within the corresponding guide channel, so as to retain said plate to said backplate.

It is another aspect of the present invention to provide a utility panel comprising a backplate adapted to be mounted to a support structure so as to form at least one guide channel therebetween, said backplate including a lock tab associated with at least one said guide channel; a plate having a pair of spaced lateral sections extending at a substantially right angle from a main section to form a receiving channel therebetween configured to receive said backplate therein; and a retention tab extending from at least one of said lateral sections, said retention tab configured to engage at least one said lock tab as at least one of said lateral sections is received within said at least one guide channel, so as to retain said plate to said backplate.

Yet another aspect of the present invention is to provide a utility panel comprising a pair of spaced lateral sections that extend at a substantially right angle from a main section, so as to form a receiving channel; a retention leg extending from each of said lateral sections into said receiving channel, such that each said retention leg includes a receiving aperture therethrough; and a flexible retention tab extending from within each said receiving aperture to a point outside said receiving aperture.

BRIEF DESCRIPTION OF THE DRAWINGS

These and other features and advantages of the present invention will become better understood with regard to the following description, appended claims, and accompanying drawings wherein:

FIG. 4 is a front perspective view of the utility panel configured for attachment to the backplate of the dispenser in accordance with the concepts of the present invention;

FIG. 4A is a perspective view of a retention leg provided by the utility panel in accordance with the concepts of the present invention;

FIG. 5 is a rear perspective view of the utility panel in accordance with the concepts of the present invention;

FIG. 5A is a perspective view of another retention leg provided by the utility panel in accordance with the concepts of the present invention;

DETAILED DESCRIPTION OF THE INVENTION

Figure 1:
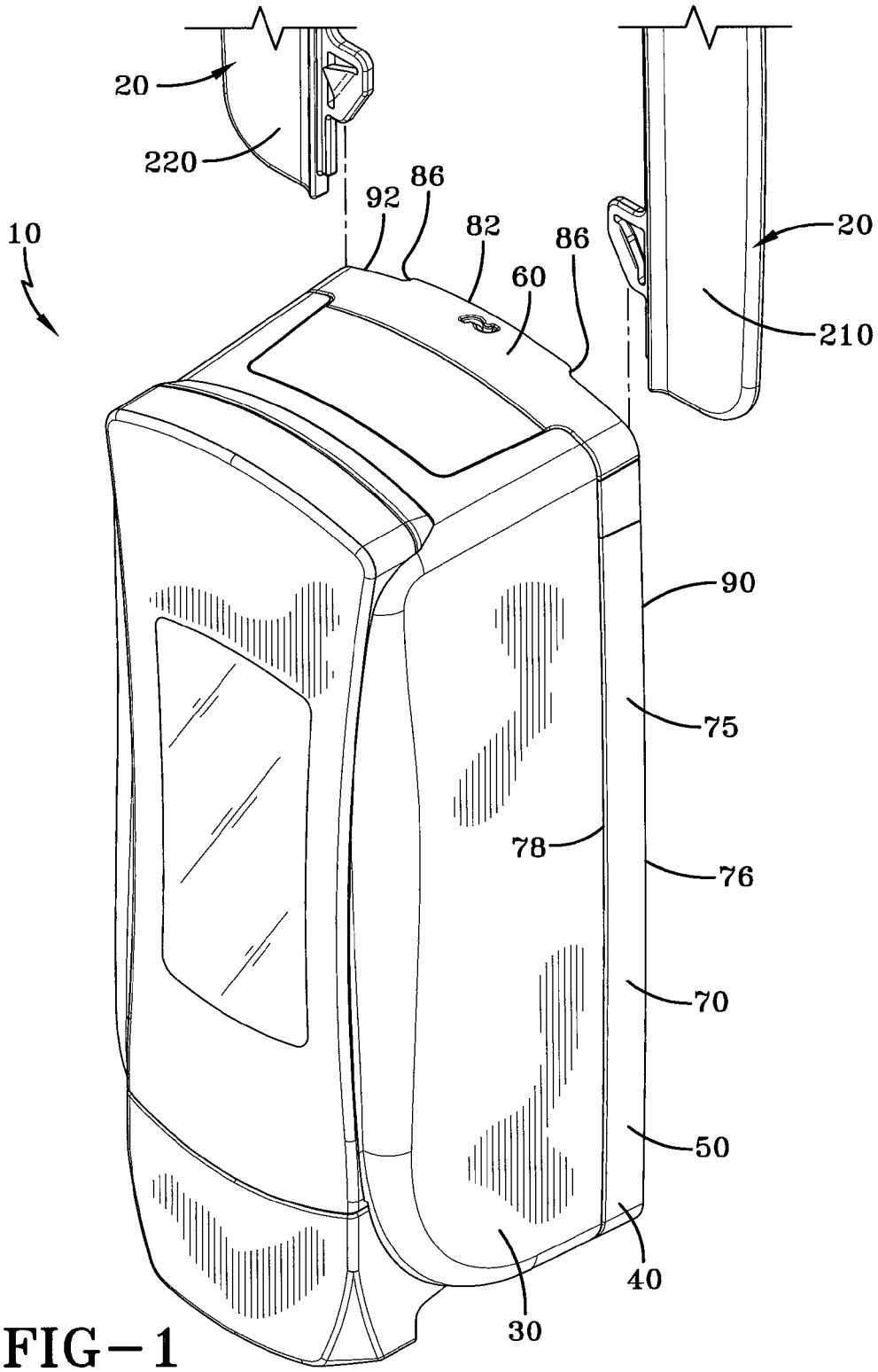
FIG. 1 is a perspective view of a dispenser that is mounted to a support structure via a backplate in accordance with the concepts of the present invention.
Figure 2:
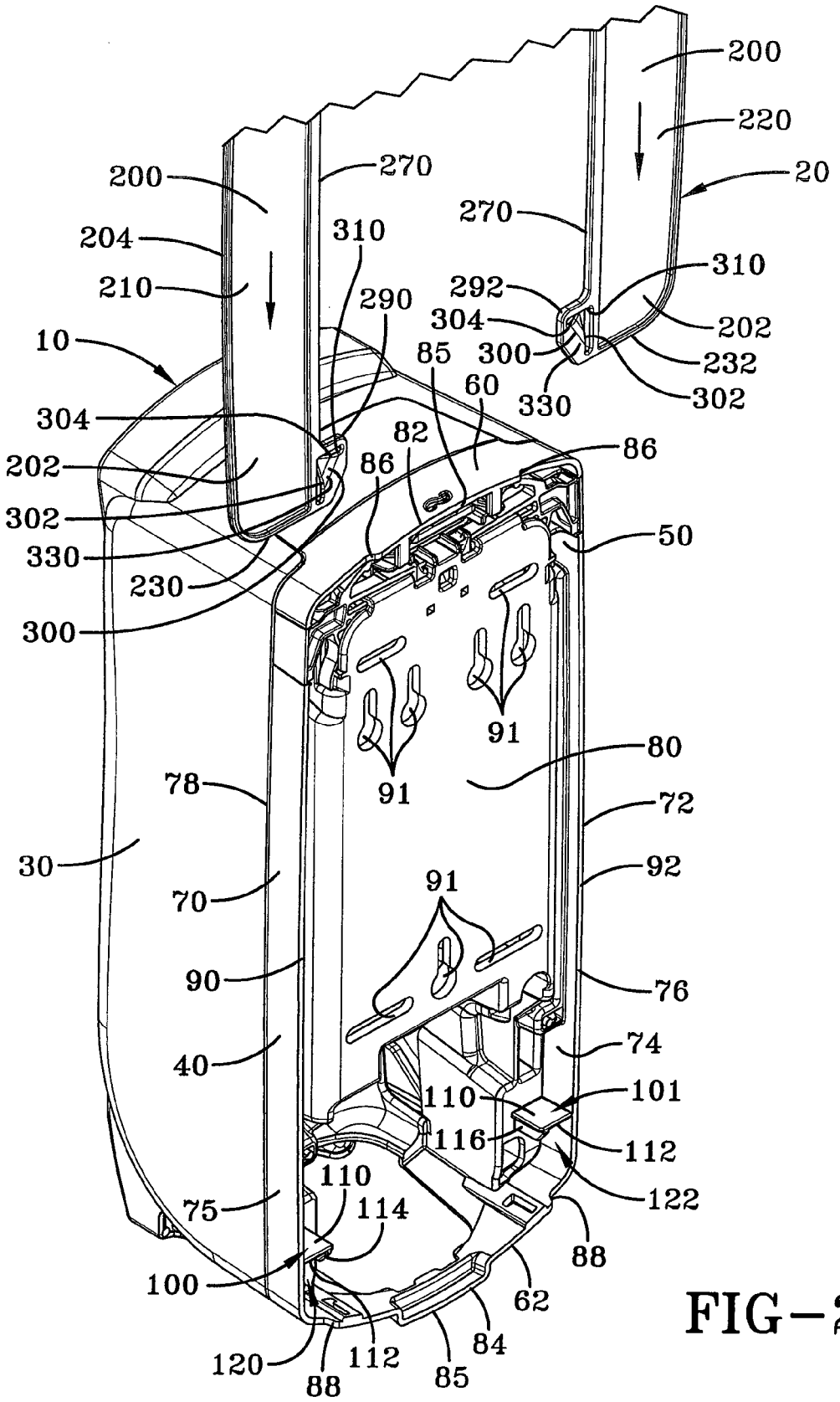
FIG. 2 is a rear perspective view of the backplate provided by the dispenser in accordance with the concepts of the present invention.
Figure 3:
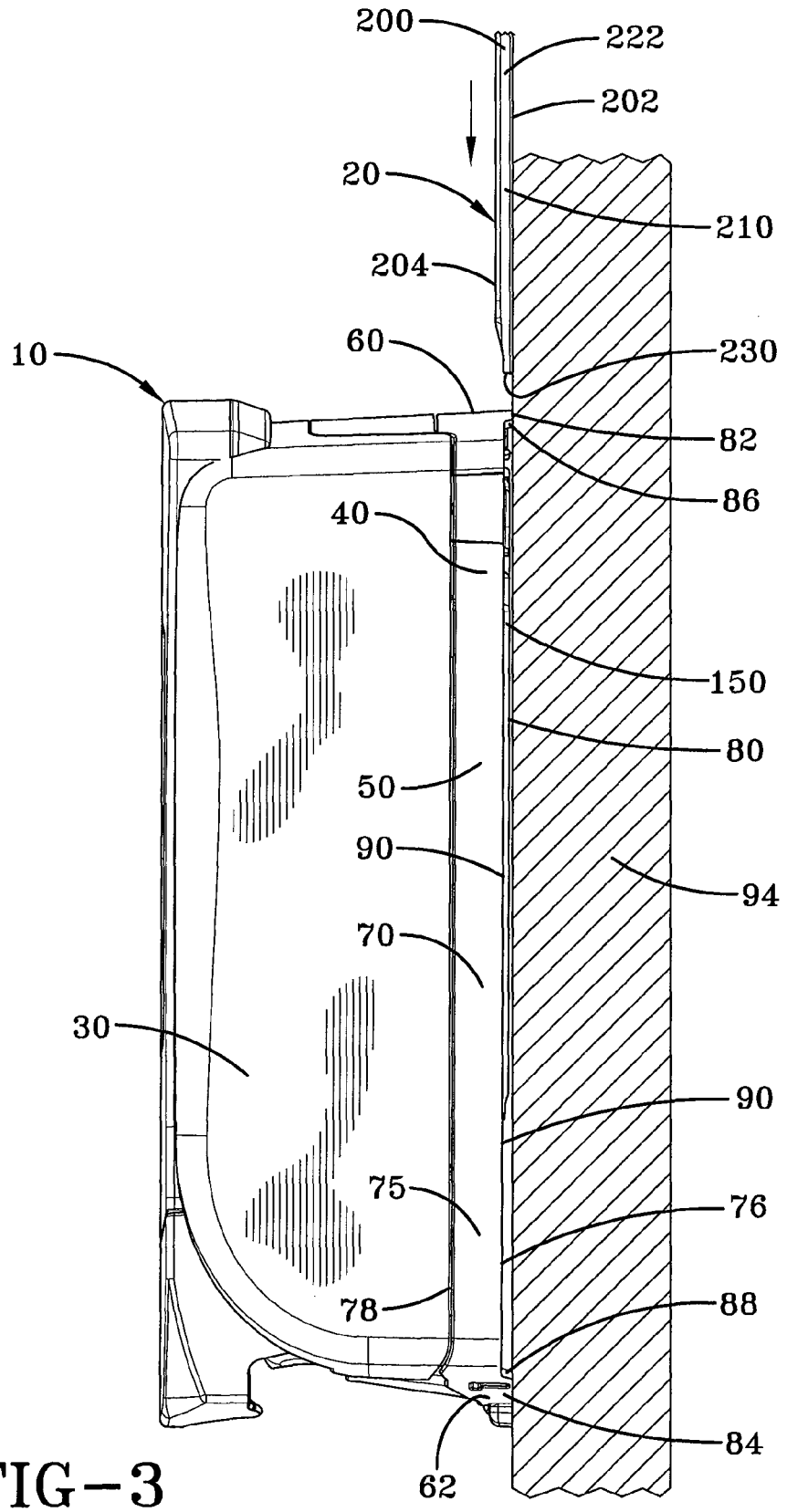
FIG. 3 is a side elevational view showing a utility panel being slideably received within a receiving channel defined between the backplate of the dispenser and the support surface in accordance with the concepts of the present invention.

A utility panel for a dispenser 10 is generally referred to by numeral 20, as shown in the Figs. of the drawings. Specifically, the dispenser 10, as shown in FIGS. 1-3, comprises a cover 30 that is pivotably mounted to a backplate 40. The backplate 40 comprises a substantially rectangular wall 50 that is configured with opposed upper and lower sections 60 and 62 that are joined by opposed lateral sections 70 and 72. The sections 60, 62 and 70, 72 of the wall 50 include inner and outer surfaces 74 and 75 that are bounded by an inner edge 76 and an opposed outer edge 78. Disposed between the respective lateral sections 70, 72 of the wall 50 is a mounting section 80, which is configured to extend beyond the inner edge 76 of the wall 50 of the backplate 40. The upper and lower sections 60, 62 of the wall 50 include respective offset sections 82 and 84 that extend away from the inner edge 76 to form an offset edge 85 that is terminated by respective ends 86 and 88. As such, the inner edge 76 of the backplate 40 is divided by the offset edge 85 of each offset section 82, 84 into a set of recessed lateral edges 90 and 92 that extend between the ends 86 and 88 of each offset section 82, 84, such that recessed lateral edge 90 extends along lateral section 70 and recessed lateral edge 92 extends along lateral section 72. Disposed through the mounting section 80 are a plurality of mounting apertures 91 through which various fasteners are received to secure the backplate 40 to a support structure 94, which may comprise any suitable structure, such as a wall.

The backplate 40 also includes a pair of lock tabs 100 and 101, each of which extend at a substantially right angle from the inner surface 74 of respective lateral sections 70 and 72 at a point that is proximate to the lower section 62 of the backplate 40. The lock tabs 100, 101 include opposed upper and lower surfaces 110 and 112, whereby lock arms 114 and 116 extend from the lower surface 112 of each of the lock tabs 100, 101 at a substantially right angle. As such, the lock tabs 100, 101 and the respective lock arms 114, 116 together form corresponding lock channels 120 and 122.

Figure 3A:
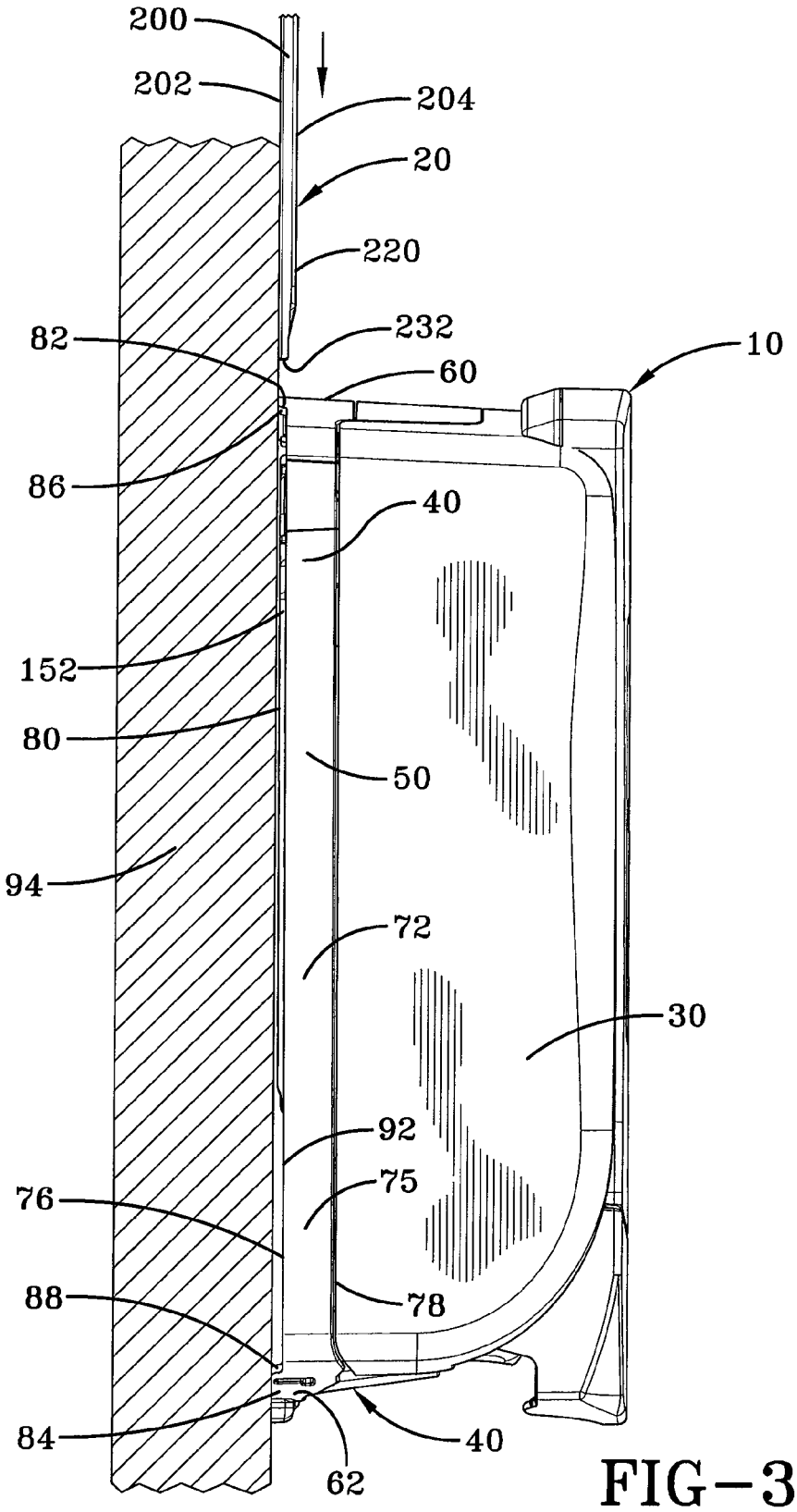
FIG. 3A is another side elevational view showing the utility panel being slideably received within the receiving channel in accordance with the concepts of the present invention.
Figure 6:
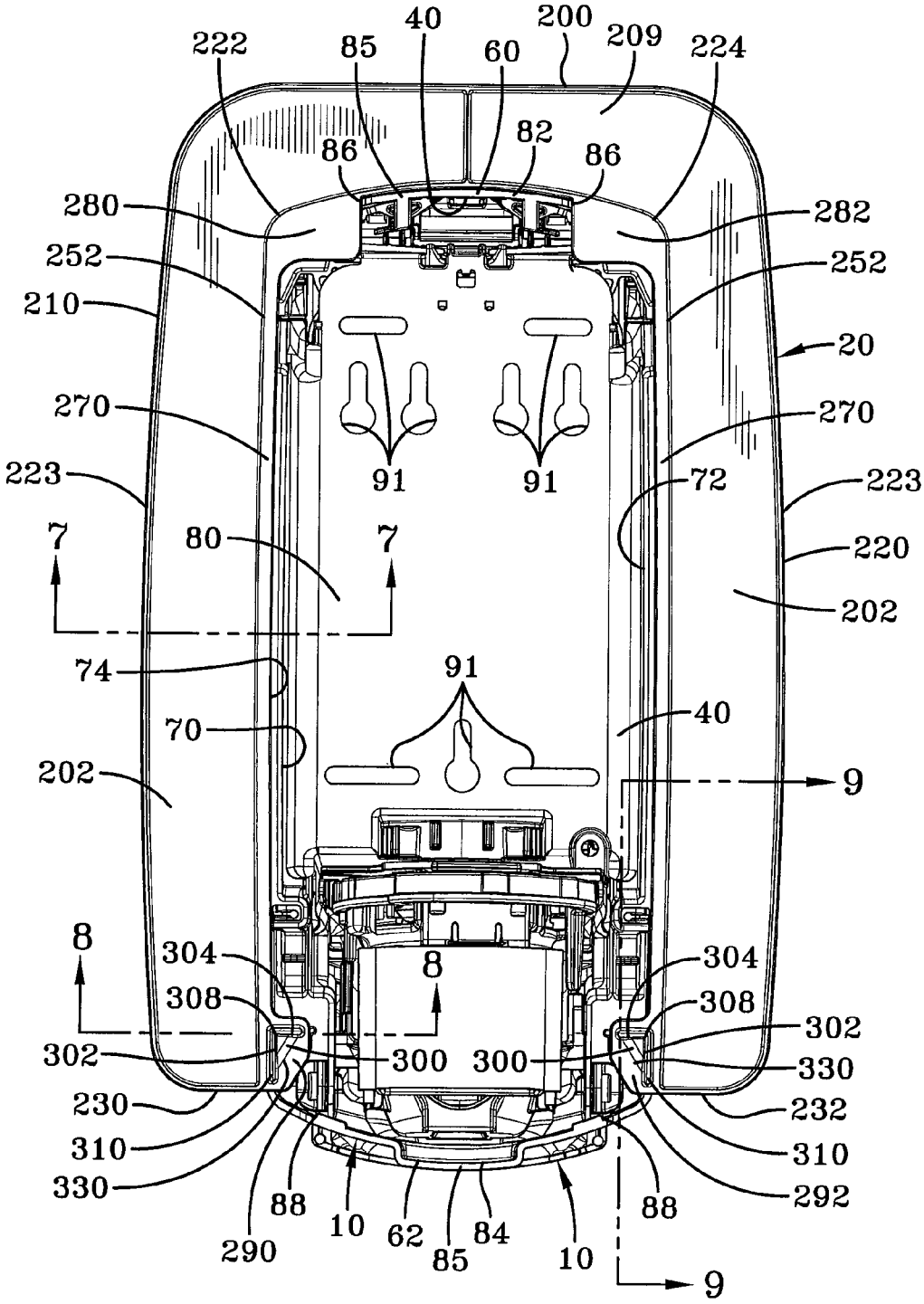
FIG. 6 is a rear elevational view of the utility panel mounted to the backplate of the dispenser in accordance with the concepts of the present invention.
Figure 7:
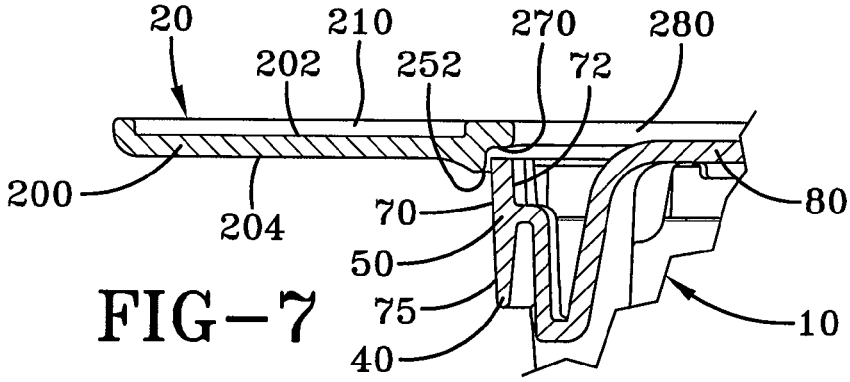
FIG. 7 is a cross-sectional view of the utility panel and backplate showing the positional relationship between a ledge of the utility panel and the backplate in accordance with the concepts of the present invention.
Figure 8:
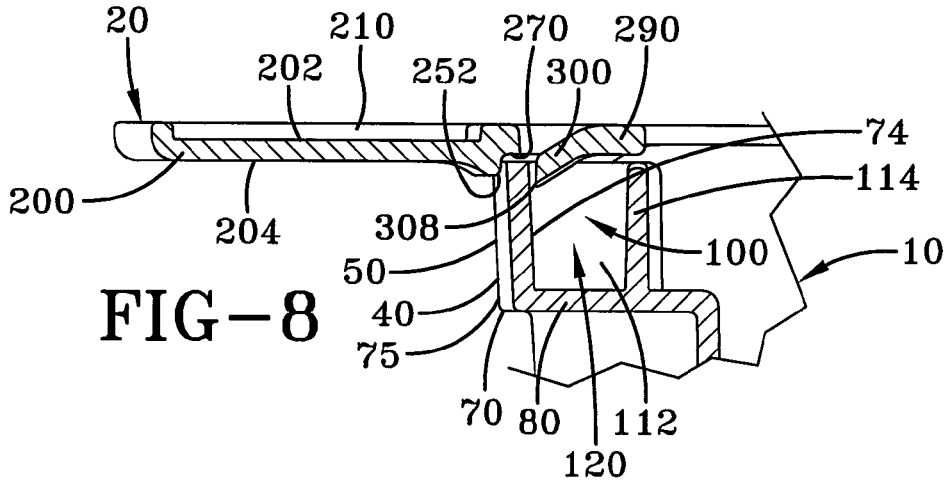
FIG. 8 is another cross-sectional view of the utility panel and backplate showing the retention legs in accordance with the concepts of the present invention.
Figure 9:
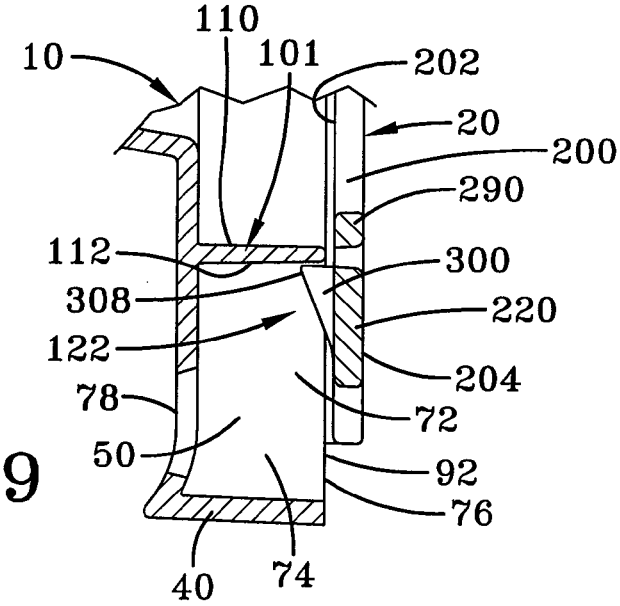
FIG. 9 is another cross-sectional view of the utility panel and backplate showing the retention legs in accordance with the concepts of the present invention.
Figure 10:
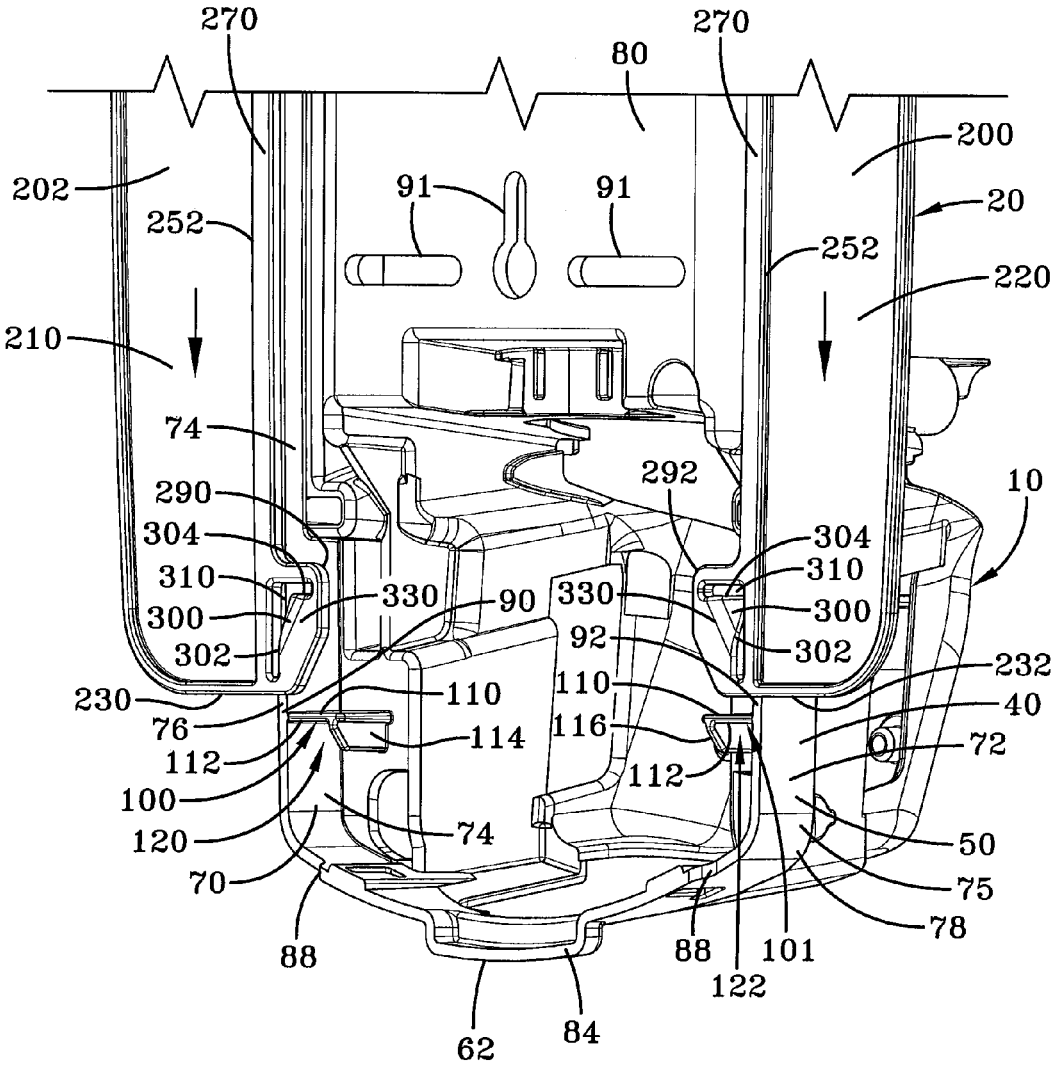
FIG. 10 is a perspective view showing the retention legs of the utility panel sliding downward into engagement with lock tabs of the backplate in accordance with the concepts of the present invention.
Figure 11:
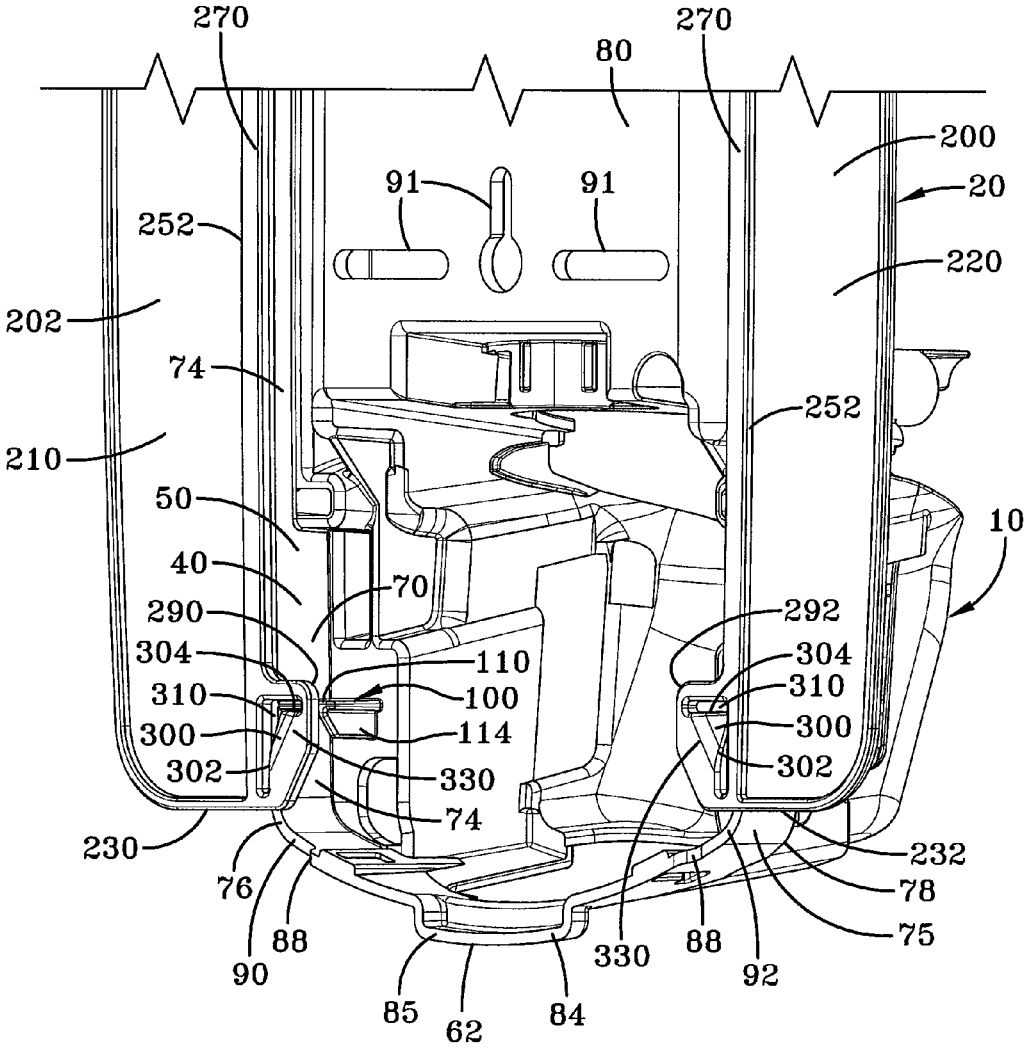
FIG. 11 is a perspective view showing the retention tabs of the utility panel when they are engaged with the lock tabs of the backplate in accordance with the concepts of the present invention.

To attach the backplate 40 to the support structure 94, screws or other threaded fasteners are inserted through the mounting apertures 91 of the mounting section 80, whereupon they are threadably fastened in the support structure 94. Alternatively, in lieu of the use of threaded fasteners, double-sided tape or other suitable adhesive may be applied to the mounting section 80 in order to secure it to the support structure 94. Thus, the offset edge 85 of the offset sections 82 and 84 and the mounting section 80 are disposed adjacent to the support structure 94. Thus, because the mounting section 80 extends beyond the inner edge 76 of the wall 50 and the extension of the offset sections 82 and 84 away from the inner edge 76 of the backplate 40, as shown in FIG. 3, the recessed lateral edges 90 and 92 of the wall 50 are offset, or spaced apart, from the support structure 94 to which it is attached. As a result, respective lateral guide channels 150 and 152, shown in FIGS. 3 and 3A, are formed between the recessed lateral edges 90, 92 of the wall 50 and the support structure 94, which are dimensioned to slideably receive the utility panel 20 in a manner to be discussed below.

The utility panel 20, as shown in FIGS. 2-12, and more clearly in FIGS. 4-5, comprises a substantially flat plate or panel section 200 having opposed inner and outer surfaces 202 and 204. Specifically, the substantially flat plate section 200 includes a main section 209 from which respective lateral sections 210 and 220 continuously extend at a substantially right angle therefrom at respective corners 222 and 224 and are terminated at respective end edges 230 and 232. As such, the main section 209 and the lateral sections 210 and 220 together form a receiving channel 250, that is bounded by a channel surface 252, and that is dimensioned to receive the mounting plate 40 therein. Extending from the channel surface 252 of the receiving channel 250 is a ledge 270, which is dimensioned to be adjacent to the inner edge 76 of the wall 50 when the utility panel 20 is attached to the dispenser 10 in a manner to be discussed.

As shown clearly in FIGS. 4-4A and 5-5A, respective support sections 280, 282, extend from the ledge 270 at each of the corners 222, 224, while retention legs 290 and 292 extend from the ledge 270 of respective lateral sections 210, 220 at a point that is proximate to the ends 230 and 232 of the lateral sections 210, 220. The retention legs 290 and 292, shown in FIGS. 4-9, include a flexible retention tab 300 that comprises a lateral edge 302 from which extends an overhead edge 304 at a substantially right angle to form a retention tip 308. In particular, the lateral edge 302 of the retention tab 300 is configured to be substantially parallel to the ledge 270, while the overhead edge 304 is substantially perpendicular to the ledge 270 provided by the respective lateral sections 210 and 220. Moreover, the flexible retention tab 300 is permitted to flexibly move or translate through a receiving aperture 310 disposed through the retention legs 290 and 292 at a pivot or flexible point 330, while the retention tip 308 extends from the outer surface 204 of the plate 200.

Figure 12A:
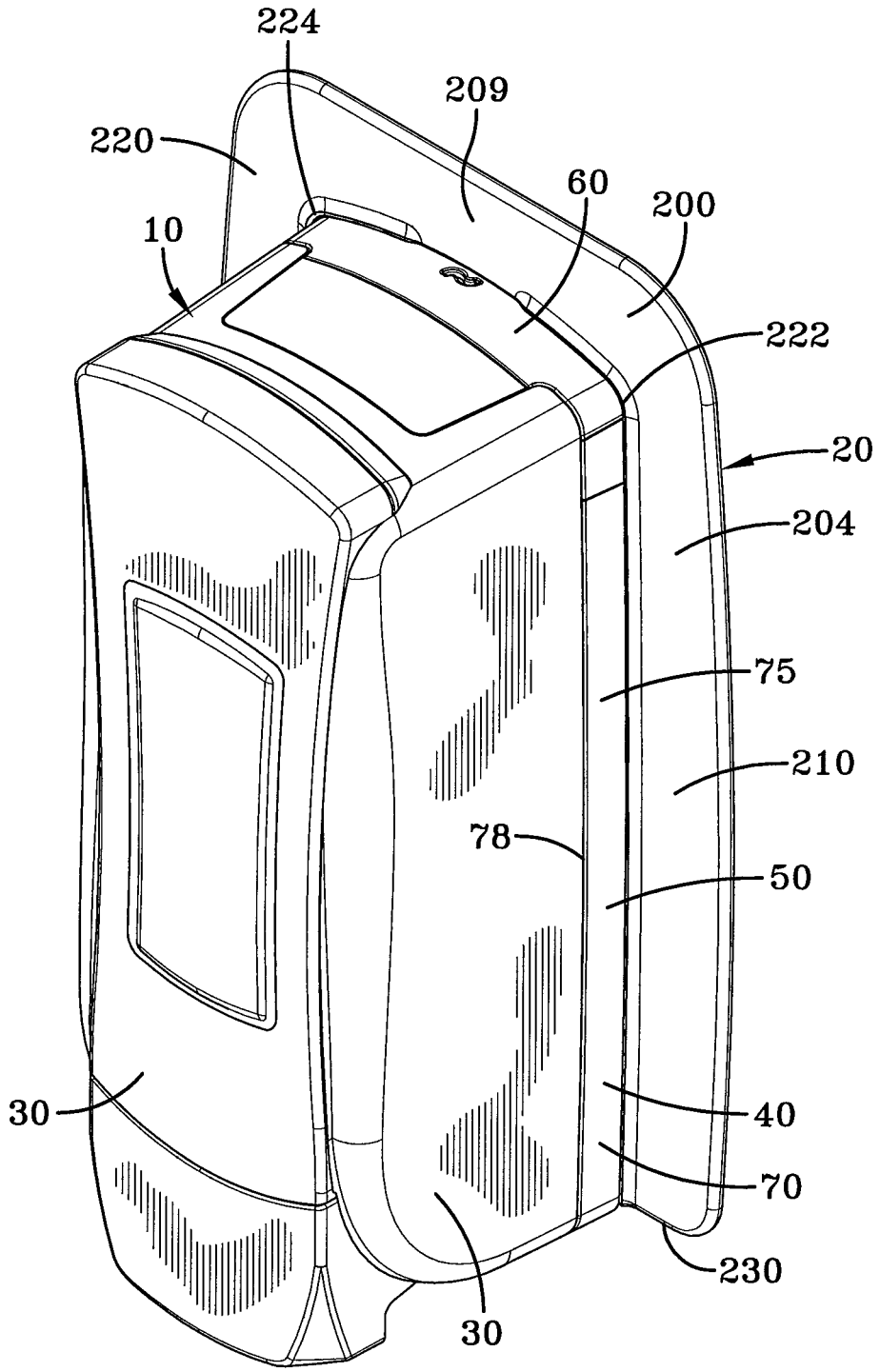
FIG. 12A is a front perspective view of the utility panel attached to the backplate of the dispenser in accordance with the concepts of the present invention.
Figure 12B:
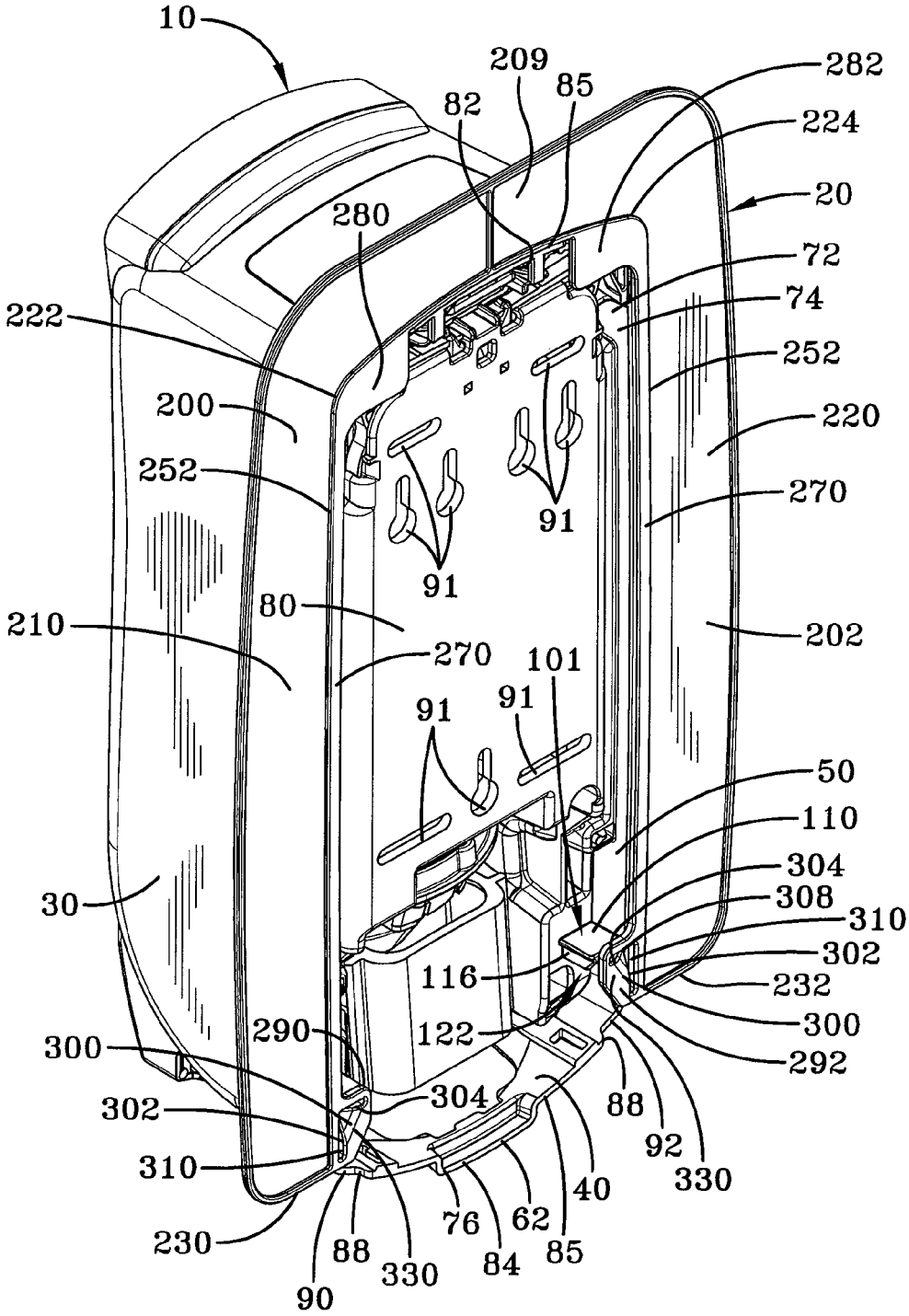
FIG. 12B is a rear perspective view of the utility panel attached to the backplate of the dispenser in accordance with the concepts of the present invention.

Thus, once the dispenser 10 is installed and mounted to the support structure 94, guide channels 150 and 152 are formed between the recessed edges 90 and 92 and the support structure 94, as previously discussed. Next, the utility panel 20 is placed above the backplate 40, as shown in FIGS. 3 and 3A, such that the inner surface 202 of the utility panel 20 is adjacent to the support structure 94 as the backplate 40 is received within the receiving channel 250 of the utility panel 20. Continuing, the utility panel 20 is then slid downward so that the retention legs 290, 292 of the lateral sections 210, 220 are received within the respective guide channels 150 and 152, and the backplate 40 is received within the receiving channel 250 of the utility panel 20. As the lateral sections 210 and 220 of the utility panel 20 are slid downward, the retention tip 308 of the retention tab 300 provided by each retention leg 290, 292 is compressed by corresponding lock tabs 100, 101 of the backplate 40 until each retention tab 300 is released or snap-fit within the corresponding lock channels 120 and 122. Once released, the retention tab 300 of the retention legs 290, 292 is engaged against the lower surface 112 of each lock tab 100, 101, so as to retain the utility panel 20 to the backplate 40 of the dispenser 10, as shown in FIGS. 12A-B. In addition, as the plate 200 is slid downward, support sections 280, 282 are also received within the corresponding guide channels 150, 152 to provide additional support to the utility panel 20.

Figure 13A:
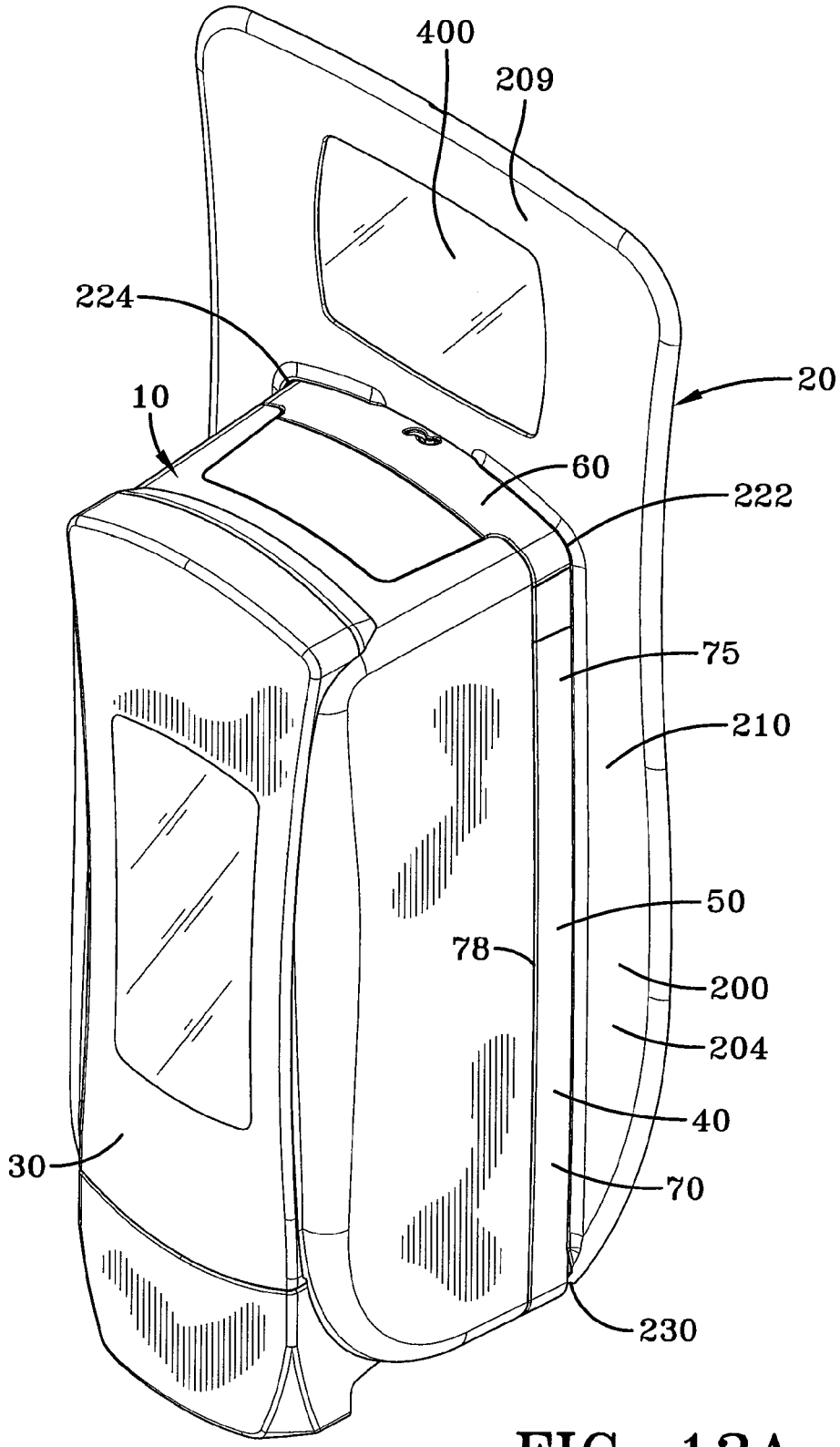
FIG. 13A shows a front perspective view of an alternative utility panel with a window to allow physical indicia disposed therein to be viewed by a user of the dispenser in accordance with the concepts of the present invention.
Figure 13B:
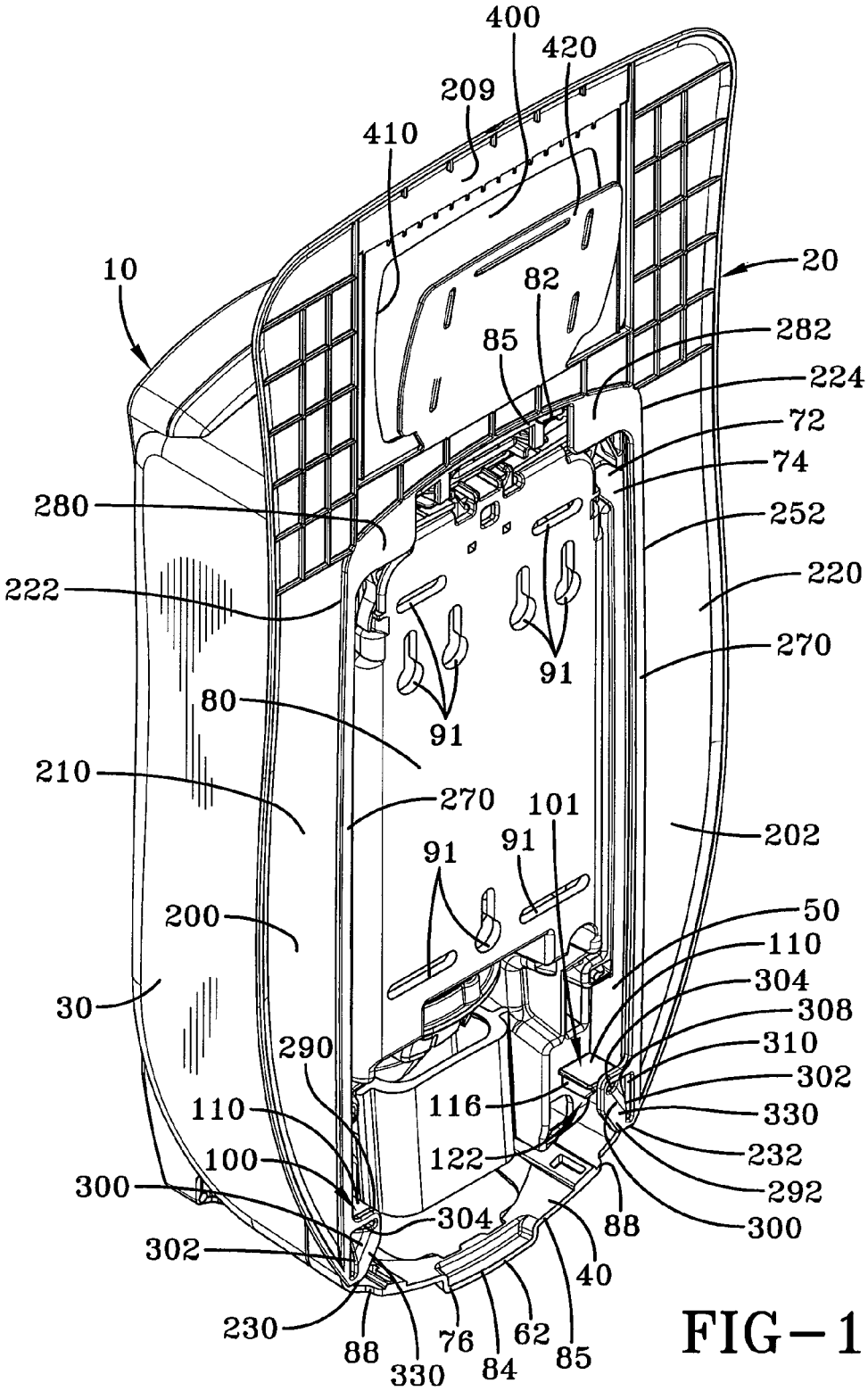
FIG. 13B shows a rear perspective view of the alternative utility panel having a door to selectively access the physical indicia disposed in the window in accordance with the concepts of the present invention.

In another embodiment of the utility panel 20, shown in FIGS. 13A-B of the drawings, the main section 209 includes a window 400. The window 400 may comprise any suitable transparent or partially-transparent material, such as glass or plastic. A retention wall 410 extends from the inner surface 202 of the plate 200 that is configured to receive and support physical indicia so that it is adjacent to the window 400. A removable or pivoting door 420 is attached to the inner surface 202 of the plate 200 and is used to retain the physical indicia in position, adjacent to the window 400, so that it can be viewed by users of the dispenser 10 when the utility panel 20 is attached thereto. Moreover, the door 420 may be used to remove and replace the physical indicia as desired.

In another aspect, the window 400 provided by the main section 209 may be replaced with any suitable material, such as plastic, cork, or cardboard, to allow a user to physically post and retain various physical indicia of any desired medium, such as an advertising sign, poster, or stickers for example, using any desired means of fixation, such as a tack, staple, adhesive, or the like. In addition the outer surface 204 of the main section 209 may be preformed with any desired indicia, such as markings, symbols, or the like, which are viewable by users of the dispenser 10. In another aspect, the main section 209 may take on any desired dimension to allow the desired physical indicia to be presented.

Figure 14:
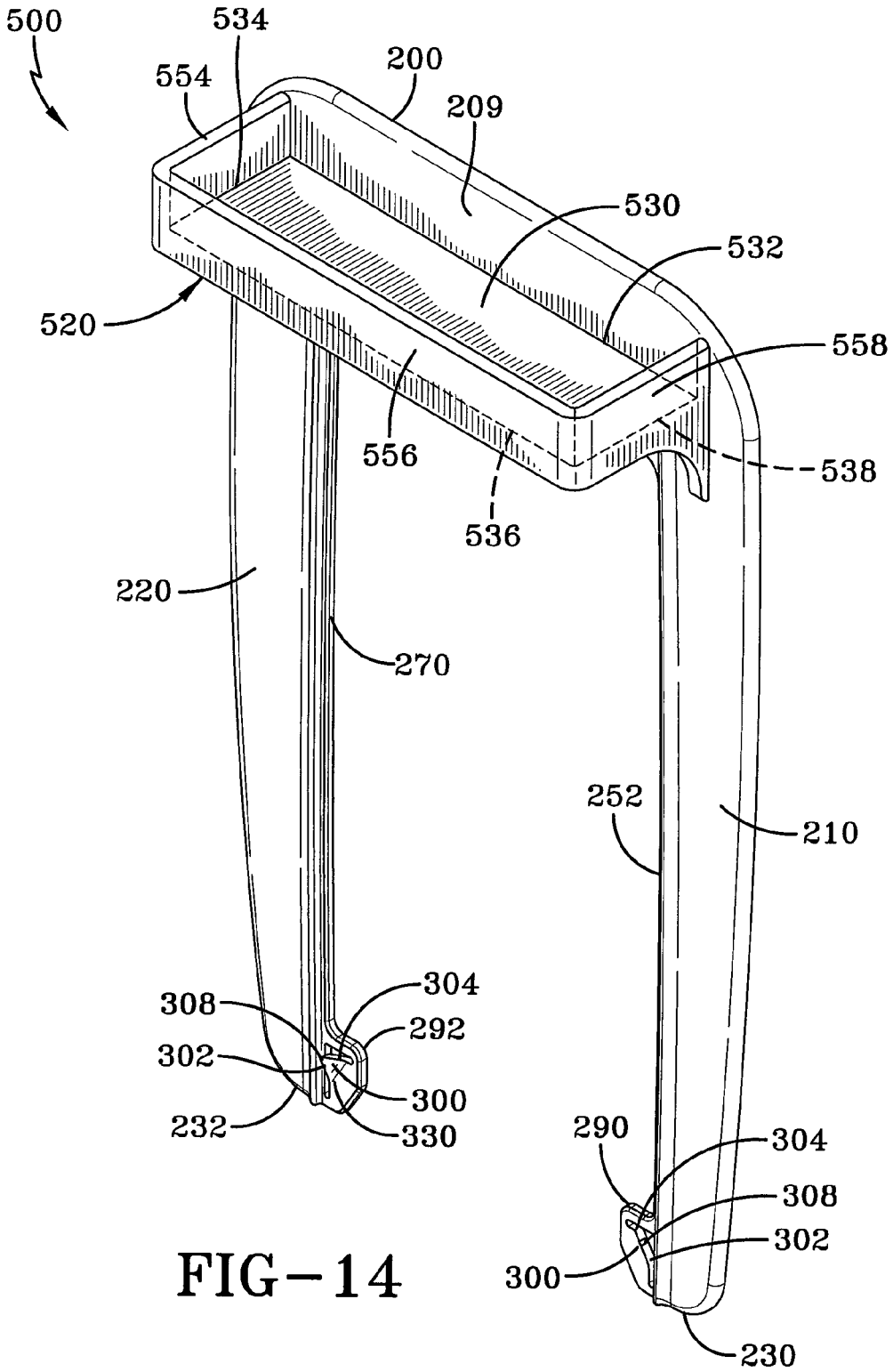
FIG. 14 shows a front perspective view of an alternative utility panel that includes a shelf in accordance with the concepts of the present invention.

In yet another embodiment a utility panel referred to by numeral 500, which is structurally equivalent to the utility panel 20, is shown in FIG. 14 of the drawings, but includes a shelf 520. Specifically, the shelf 520 is configured to extend from the main section 209 of the panel 200. The shelf 520 includes a base 530 that is surrounded on one edge 532 by the main section 209, and on its remaining edges 534, 536, and 538 by respective wall sections 554, 556, and 558. However, it should be appreciated that the base 532, although shown as a substantially flat section, may comprise any cross-sectional shape including a curvilinear or rectilinear shape or a combination of both and may or may not be used in conjunction with the wall sections 554-558. As such, the shelf 520 provides a convenient storage area in which various items, including soap and shampoo containers, can be stored for example, when the utility panel 500 is attached to the backplate 40.

Figure 15:
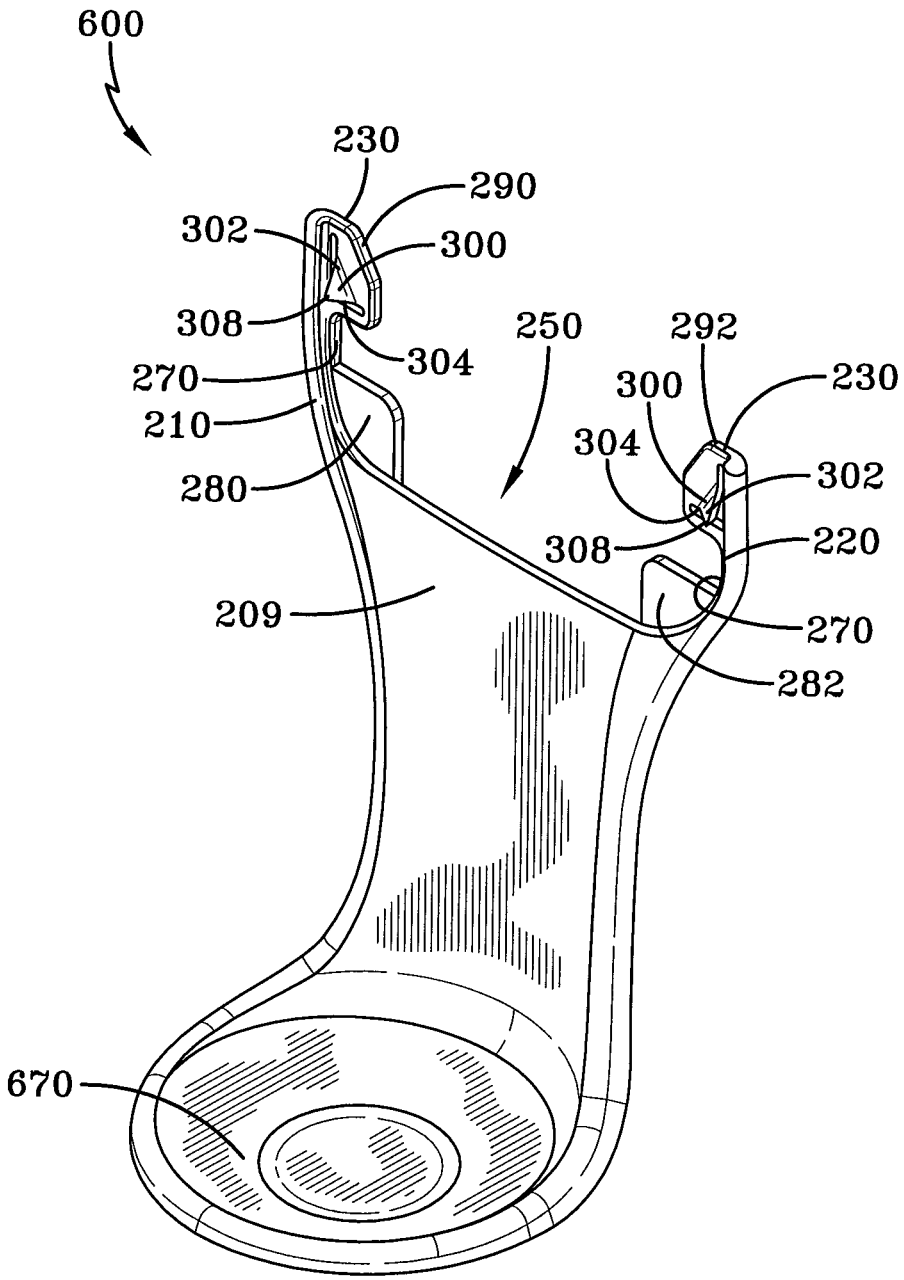
FIG. 15 shows a front perspective view of another alternative utility panel that includes a drip tray in accordance with the concepts of the present invention.

In still another embodiment, a utility panel referred to by numeral 600, which is shown in FIG. 15 of the drawings, is structurally equivalent to the utility panel 20, except for the configuration of the main section 209. Specifically, the main section 209 is elongated, and extends away from the receiving channel 250 whereupon it is terminated by a drip tray 670 that extends at a substantially right angle from the main section 209. As such the utility panel 600 is configured to be attached adjacent to the lower section 62 of the backplate 40, such that the retention tabs 300 of each lateral section 210 and 220 are engaged with the respective lock tabs 100 and 101 of the backplate 40. As such, when the utility panel 600 is attached to the backplate 40 provided by the dispenser 10, it is able to catch any residual material that may flow or drool from the nozzle of the dispenser 10 attached to the backplate 40, so as to prevent a mess from developing on the floor, counter or any other surrounding areas where the dispenser 10 may be mounted.

Thus, while the various utility panels 20, 500, and 600 may be used in association with the backplate 40 that is part of the dispenser 10, it is also contemplated that the backplate 40 may be used independently without the dispenser 10. As such, the backplate 40 may serve simply as a base that enables the attachment of the various utility panels 20, 500, and 600 to a desired surface or structure to which the backplate 40 is attached.

It will, therefore, be appreciated that one advantage of one or more embodiments of the present invention is that a utility panel for a wall-mounted dispenser is easily retrofit thereto without the need for tools. Another advantage of the present invention is that the utility panel for a wall-mounted dispenser provides a viewing window to allow indicia to be removably installed in a window for viewing by users of the dispenser. Still another advantage of the present invention is that the utility panel may be attached to a backplate that is configured to be attached to any desired surface. Yet another advantage of the present invention is that various utility panels having specific functions may be interchangeably attached to the backplate.

Although the present invention has been described in considerable detail with reference to certain embodiments, other embodiments are possible. Therefore, the spirit and scope of the appended claims should not be limited to the description of the embodiments contained herein.

What is claimed is:

1. A utility panel for a backplate configured to carry a dispenser for dispensing material therefrom, the backplate adapted to be removably mounted to a support structure, such that the backplate and the support structure defines at least two guide channels therebetween, the backplate including a lock tab associated with at least one of the guide channels, the utility panel comprising:

a plate having a first and a second lateral section extending at a substantially right angle from a main section, said first and second lateral sections spaced apart to form a receiving channel therebetween that is configured to receive the backplate therein, a retention leg extending from each said first and second lateral section and into said receiving channel, such that each said retention leg is configured to be received within one of the guide channels; and a retention tab extending from at least one said retention leg, said retention tab configured to engage the at least one lock tab as said retention legs are received within the guide channels, so as to retain said plate to the backplate, whereupon said main section and said first and second lateral sections substantially surround the periphery of the backplate.

2. The utility panel of claim 1, wherein said main section includes a window to display physical indicia.

3. The utility panel of claim 2, further comprising a door attached to said plate to selectively retain the indicia adjacent to said window.

4. The utility panel of claim 1, further comprising at least one support section extending from said main section into said receiving channel for receipt within the at least one guide channel.

5. The utility panel of claim 1, further comprising at least one support section extending from at least one said lateral section for receipt within the at least one guide channel.

6. The utility panel of claim 1, wherein said main section includes indicia disposed thereon.

7. The utility panel of claim 1, wherein said main section includes a shelf attached thereto.

8. The utility panel of claim 1, wherein said main section includes a drip tray attached thereto.

9. A utility panel comprising:

a backplate configured to carry a dispenser from which material is dispensed therefrom, said backplate adapted to be removably mounted to a support structure, such that said backplate and the support structure define at least two guide channels therebetween, said backplate including a lock tab associated with at least one of said guide channels;

a plate having a first and a second lateral section extending at a substantially right angle from a main section, said first and second lateral sections spaced apart to form a receiving channel therebetween that is configured to receive said backplate therein, a retention leg extending from each said first and second lateral sections and into said receiving channel, such that each said retention leg is configured to be received within one of the guide channels; and a retention tab extending from at least one said retention leg, said retention tab configured to engage at least one said lock tab as said retention legs are received within said at least one guide channels, so as to retain said plate to said backplate, whereupon said main section and said first and second lateral sections substantially surround the periphery of said backplate.

10. The utility panel of claim 9, wherein said main section includes a window to display physical indicia therein.

11. The utility panel of claim 10, further comprising a door attached to said plate to selectively retain the indicia adjacent to said window.

12. The utility panel of claim 9, further comprising at least one support section extending from said main section into said receiving channel for receipt within said at least one guide channel.

13. The utility panel of claim 9, further comprising at least one support section extending from each said at least one lateral section for receipt within said at least one guide channel.

14. The utility panel of claim 9, wherein said main section includes indicia disposed thereon.

15. The utility panel of claim 9, wherein said main section includes a shelf attached thereto.

16. The utility panel of claim 9, wherein a dispenser is attached to said backplate, said dispenser configured to dispense material from a nozzle when operated.

17. The utility panel of claim 16, wherein said main section includes a drip tray attached thereto, said drip tray configured to be disposed beneath said nozzle of said dispenser.

18. A utility panel for attachment to a backplate that is removably mounted to a support structure, the backplate configured to carry a dispenser used to dispense material therefrom comprising:

a first and second lateral section that extend at a substantially right angle from a main section, said first and second lateral sections spaced apart, so as to form a receiving channel therebetween;

a retention leg extending from each said first and second lateral section, such that said first and second lateral sections extend into said receiving channel, each said retention leg including a receiving aperture disposed therethrough; and a flexible retention tab extending from within each said receiving aperture to a point outside said receiving aperture to selectively engage a lock tab provided by the backplate, whereupon said main section and said first and second lateral sections substantially surround the periphery of the backplate.

19. The utility panel of claim 18, wherein said main section includes a window to display physical indicia therein.

20. The utility panel of claim 18, wherein said main section includes a shelf attached thereto.

21. The utility panel of claim 18, wherein said main section includes a drip tray attached thereto.

* * * * *